United States Patent [19]

Frost et al.

[11] Patent Number: 4,579,329

[45] Date of Patent: Apr. 1, 1986

[54] SINGLE PLY PICKUP APPARATUS AND METHOD

[75] Inventors: Walter W. Frost; Ralph Hackle, both of Vidalia, Ga.

[73] Assignee: Oxford Industries, Inc., Vidalia, Ga.

[21] Appl. No.: 556,975

[22] Filed: Dec. 1, 1983

[51] Int. Cl.[4] ..... B65H 3/50; B65H 3/20

[52] U.S. Cl. ..... 271/10; 271/122; 271/33

[58] Field of Search ..... 271/4, 5, 10, 11, 33, 271/104, 105, 106, 122, 190; 270/54, 55, 57; 414/114; 221/210

[56] References Cited

U.S. PATENT DOCUMENTS

| | | | |
|---|---|---|---|
| 2,796,256 | 6/1957 | Robertson | 271/11 |
| 2,919,129 | 12/1959 | Sjostrom | 271/33 |
| 2,950,675 | 8/1960 | Copping et al. | 271/122 |
| 3,265,383 | 8/1966 | Shute | 271/11 |
| 3,386,396 | 6/1968 | Jacobs et al. | 271/33 |
| 3,411,772 | 11/1968 | Rovin | 271/236 |
| 3,531,107 | 9/1970 | Rovin et al. | 271/236 |
| 3,539,177 | 11/1970 | Schwenk | 271/33 |
| 3,588,096 | 6/1971 | Leiter | 271/236 |
| 3,670,674 | 6/1972 | Conner, Jr. | 271/33 |
| 3,765,672 | 10/1973 | Conner, Jr. | 271/33 |
| 3,768,807 | 10/1973 | Spengler | 271/190 |
| 3,773,317 | 11/1973 | Kummerer | 271/122 |
| 3,785,638 | 1/1974 | Beazley | 271/33 |
| 3,937,453 | 2/1976 | Hickey et al. | 271/122 |
| 3,944,211 | 3/1976 | Rasmussen et al. | 271/122 |
| 4,153,240 | 5/1979 | Gouley | 271/33 |
| 4,176,832 | 12/1979 | Hughes et al. | 271/10 |
| 4,208,046 | 6/1980 | Shimizu | 271/122 |
| 4,462,585 | 7/1984 | Gieson et al. | 271/11 |

FOREIGN PATENT DOCUMENTS

| | | | |
|---|---|---|---|
| 729011 | 12/1942 | Fed. Rep. of Germany | 271/104 |
| 0131647 | 8/1982 | Japan | 271/112 |
| 375260 | of 1932 | United Kingdom | 271/11 |

*Primary Examiner*—Bruce H. Stoner, Jr.
*Assistant Examiner*—James E. Barlow
*Attorney, Agent, or Firm*—Jones & Askew

[57] ABSTRACT

A method and apparatus for isolating, separating, and removing a single ply of material from a stack of plies including pickup fingers for lifting a peripheral edge of the topmost ply in the stack with adhesive tape, a spin off assembly for removing clinging plies from the lifted edge of the topmost ply, grasping fingers for engaging and hold the isolated ply, and a separator assembly for positively separating the topmost ply by indexing a separator rod into the gap between the uplifted peripheral edge of the topmost ply and the remaining plies and along the stack. The isolated topmost ply is removed by withdrawing the grasping fingers away from the stack. There is also disclosed an alignment apparatus including a plurality of alignment fingers which define a relatively wide ply-receiving portion and an edge stop which prevents climbing of the edge of the ply.

18 Claims, 16 Drawing Figures

SINGLE PLY PICKUP APPARATUS AND METHOD

BACKGROUND OF INVENTION

1. Field of the Invention

The present invention relates generally to material handling, and specifically relates to a method and apparatus for isolating and removing a single ply of pliable material such as cloth from a stack of plies and providing the removed ply to a work station for further processing.

2. Description of the Prior Art

In the garment manufacturing industry, pieces of cloth or other pliable material which have been cut according to a pattern are frequently stacked together by material handling equipment for interim storage or transport prior to sewing the material or performing further processing operations. There accordingly arose a need to isolate and remove a single ply from the stack so that the material can be fed into the subsequent processing equipment. Historically, when manual labor was used for many of the tasks in garment manufacture, the equipment operator would manually remove the plies of material from the stack one at a time.

With the introduction of automated high-speed garment manufacturing equipment, there arose a need to provide the supply of material to the equipment rapidly and in an aligned fashion so that the ply of material does not skew during operations such as sewing. Difficulties have been encountered in prior art material handling apparatus in that it has proven difficult to isolate and separate a single ply of material from a stack of material due the tendency of pliable material such as cloth to adhere because of static electricity, frictional clinging, and thread entanglement. The problem is compounded when the single ply is drawn laterally from the stack because the movement of the topmost ply across the stack generates additional static electricity and tends to pull any clinging plies along with the topmost ply, causing misalignment and misregistration of the plies beneath what was the topmost ply.

Various methods have been proposed for isolating and removing a single ply. In one approach, a vacuum head including a plurality of serrated teeth or needles contacts the topmost ply and lifts a portion of the ply. The sharp teeth frictionally engage the ply so as to assist in the removal of the ply since the vacuum alone may not be generally sufficient to hold a ply of porous material such as cloth as the ply is removed from the stack.

One problem with this device is that the teeth sometimes actually punch through the material and prick the next ply in the stack, thereby tending to pull more than one ply from the stack. Accordingly, a fine adjustment of the depth of needle penetration is required to insure that only the top ply is penetrated, thereby creating difficulties in compensatng for different types and thicknesses of material.

In an attempt to overcome the difficulty with this approach, a second vacuum head has been proposed to attempt to hold the second ply in the stack as the first ply is removed. This creates additional complexity in insuring that the second vacuum head is placed adjacent the second ply, since a portion of the first ply would actually have to be successfully removed from the stack so that the second vacuum head can be positioned over the next ply in the stack.

A similar approach is employed in U.S. Pat. No. 4,153,240 to Gouley, wherein brushes are used to pull the topmost ply from the stack over a suction block which holds any clinging plies while an adhesive gripping finger above the suction head engages the topmost ply and removes it. The same problem as in the above-mentioned device is encountered in that there is no assurance that the topmost ply has been positively separated from any clinging plies so as to prevent the adhesive gripping finger from carrying more than one ply to the work table. The Gouley device relies upon turning the ply over to attempt to unstick it from the next lowest ply in the stack to lower the risk of removal of more than one element in the stack.

It is known in the art to use various forms of adhesive pick-up devices in order to grasp individual sheets from a stack. Representative of these devices are U.S. Pat. Nos. 3,670,674 to Conner, Jr.; 2,919,129 to Sjostrom; 3,539,177 to Schwenk, et al.; 3,785,638 to Beazley; and 3,386,396 to Jacobs et al. Certain other known devices employ rollers to attempt to remove excess sheets or plies from a sheet being transported. Representative of these devices are U.S. Pat. Nos. 3,773,317 to Kummerer; 3,937,453 to Hickey et al.; 3,944,211 to Rasmussen et al.; and 4,208,046 to Shimizu. While these latter devices have proven effective in handling flat, sheet-like materials such as paper and the like, they have not been as successful in handling limp materials such as cloth because of the characteristic of cloth to cling because of friction and static electricity. These roller-type devices appear to depend upon the presence of a degree of longitudinal stiffness in the plies being removed so that the lower plies may be pushed away as the topmost plies are being removed.

Certain other known devices use air jets to separate additional plies from the topmost ply. Representative of this approach are U.S. Pat. Nos. 3,670,674 to Conner, Jr. and 3,539,177 to Schwenk et al.

After a single ply is isolated, there still remains the problem of registering or aligning the removed ply so that it may be fed into a work station such a sewing machine. U.S. Pat. No. 3,386,396 to Jacobs et al. shows a combined automatic sewing machine assembly having a feeder foot which includes indexed adhesive tape for picking up a ply, and which uses air jets to position the work piece for folding. U.S. Pat. Nos. 3,588,096 to Laiter et al. and 3,531,107 to Rovin et al. align the fabric pieces with pulsating jets of air. U.S. Pat. No. 3,411,772 to Roven attempts to register a workpiece with suction devices.

The problem with these and other similar registration devices is that the stops typically used to register the piece of fabric have vertical surfaces which the peripheral edges of the plies have a tendency to climb. This can cause warping, misregistration and buckling due to the limpness of the plies if the plies are continued to be forced toward the stop after the peripheral edge has touched the stop.

SUMMARY OF THE INVENTION

The present invention overcomes these and other problems encountered in prior art single ply handling apparatus by insuring positive separation of a single ply from the stack. The method employed in the preferred embodiment in order to isolate and remove a single ply from the stack includes the steps of engaging the topmost ply in the stack with an adhesive-bearing lifting member, lifting a peripheral edge of the topmost ply by pivoting the adhesive-bearing lifting member, removing and clinging plies from the topmost ply by spinning off such clinging plies with a spinning wheel which is moved toward the underside of the uplifted peripheral edge of the topmost ply, grasping the uplifted peripheral edge of the topmost ply with grasping means, and positively separating the topmost ply from the remaining plies by moving a separator rod or bar into the gap between the uplifted peripheral edge of the topmost ply and the remaining plies and along the width of the stack. The topmost ply is thereby isolated and can be removed by withdrawing the grasping means away from the stack. Since positive separation of the topmost ply is accomplished by spinning off any clinging plies and by running the separator bar along the length of the topmost ply, the risk that any other plies in the stack will adhere or cling to the topmost ply is substantially reduced.

The apparatus of the preferred embodiment for providing positive separation of the topmost ply includes an adhesive lifting finger which lifts the peripheral edge of the topmost ply in order to create a gap between the topmost ply and the adjacent ply. A separator bar or rod is positioned adjacent to the peripheral edge of the topmost ply and is movable laterally with respect to the stack into the gap created by the lifting finger when the peripheral edge is lifted. An actuator then moves the separator bar into the gap and across the stack, positively separating the topmost ply from the remaining plies by breaking any static electrical or frictional bonds which may be present.

The preferred embodiment further includes a stack elevator which raises the stack of plies into proximity with the adhesive lifting finger and then lowers the stack of plies to enlarge the gap created by the lifting of the peripheral edge and to allow the separator rod to move across the stack.

A pair of endless chain loops supporting a plurality of separator rods between the chains are provided for indexing one of the separator rods along the plane of the top of the stack of plies. The ends of the separator rods are attached to one of the endless chain loops. For each ply separated, the chains are indexed a predetermined amount which moves one of the plurality of separator rods across the top of the stack, effectuating positive separation between the topmost ply and the remaining plies.

The preferred embodiment further includes means for spinning or peeling off any plies which may cling to the topmost ply. Accordingly, there is provided a reverse spinning wheel or peeler mounted to an arm which is moved into engagement with the lifted peripheral edge of the topmost ply by approaching the lifted peripheral edge from the exposed underside of the topmost ply. The spinning wheel approaches sufficiently close to the topmost ply to contact any clinging plies and to spin such plies downwardly; the reverse spinning motion causes the spun-off plies to be replaced onto the stack.

The spin off wheel or peeler in the preferred embodiment comprises a wheel mounted for rotation about an axis generally parallel to the peripheral edge of the topmost ply. The wheel is reverse spinning with respect to the direction of removal of the ply, i.e., the wheel spins in a direction such that the instantaneous velocity vector tangent to the wheel where the wheel contacts any clinging plies is directed away from the lifted peripheral edge of the topmost ply. Movement in this direction causes the removed plies to be forced back onto the stack.

The spinning wheel or peeler is mounted to an upper arm which in turn is mounted to another lower arm which is movable toward and away from the stack. Movement of the lower arm toward the stack causes the spinning wheel to engage any clinging plies. The upper arm then pivots downwardly away from the edge of the ply being removed. This action causes the spun-off plies to move back toward the stack. The spinning wheel then ceases movement and clamps against the top of the stack. The stack elevator then lowers in conjunction with the clamping movement of the upper arm so that the next ply on the stack is immobilized as the separator bar moves along the top of the stack.

Also included in the preferred embodiment are grasping fingers for grasping the topmost ply after the peeler or spin off wheel has removed any clinging plies. The grasping fingers are then operative to pull the positively separated topmost ply away from the stack and toward a work station.

The preferred embodiment further includes apparatus for aligning a particular edge of the removed ply in preparation for feeding the ply to a work station. The alignment apparatus comprises a work table for receiving the unaligned ply, and an alignment assembly which includes a plurality of alignment fingers. Each of the alignment fingers define a relatively wide ply-receiving portion disposed toward the work table and an edge stop disposed away from the work table. The fingers taper from the ply-receiving portion toward the edge stop to form a V. The edge of the ply registers in the vertex of the V. Air jets mounted in the alignment fingers and directed toward the vertex of the V force the ply into the vertex and cause the edge of the ply to register with the edge stop. The alignment assembly then moves away from the work table carrying the aligned ply toward a work station where the ply is fed into the work station.

The alignment assembly is movable in two lateral directions—between a first position wherein the alignment fingers are positioned over the work table for receiving the unaligned ply and a second position away from the work table for discharging the aligned ply, and in a second direction for moving from the second position to a third position toward the work station to feed the aligned ply into the work station. Ply suction means are provided in the work table for holding the unaligned ply on the work table while the alignment assembly positions the alignment fingers over the unaligned ply on the work table.

Accordingly, it is an object of the present invention to provide a single ply pickup apparatus which provides positive separation of adjacent plies of material in a stack of plies.

It is another object of the present invention to provide positive separation of the topmost ply from adjacent plies in a stack by moving a separator between the topmost ply and the adjacent ply and across the stack in order to break any static electrical or frictional bonds or thread entanglement between the topmost ply and the adjacent plies.

It is another object of the present invention to provide an apparatus for isolating the topmost ply of the stack of plies by peeling or spinning off any plies which may cling to the topmost ply.

It is another object of the present invention to provide an apparatus for isolating the topmost ply of the stack of plies by engaging a lifted peripheral edge of the topmost ply and removing from the topmost ply any clinging peripheral edges of the remaining plies in the stack.

It is another object of the present invention to provide an apparatus for isolating a peripheral edge of the topmost ply of a stack of plies so that the topmost ply can be grasped and removed for subsequent processing.

It is another object of the present invention to provide an apparatus for holding any plies which have been removed from an isolated topmost ply of a stack of plies by engaging any plies which may cling to the topmost ply, removing these clinging plies, and clamping them against the top of the stack so that the isolated topmost ply can be removed.

It is another object of the present invention to provide an apparatus for aligning a particular edge of a ply of material in preparation for the feeding the aligned ply to a work station.

It is another object of the present invention to provide an apparatus for aligning a ply of material by employing a V-shaped registration stop which prevents the edge of the ply to be aligned from climbing the registration stop and buckling the ply.

These and other objects, features, and advantages of the present invention may be more clearly understood and appreciated from a review of the following detailed description of the disclosed embodiment and by reference to the appended drawings and claims.

DETAILED DESCRIPTION OF THE PREFERRED EMBODIMENT

Figure 1:
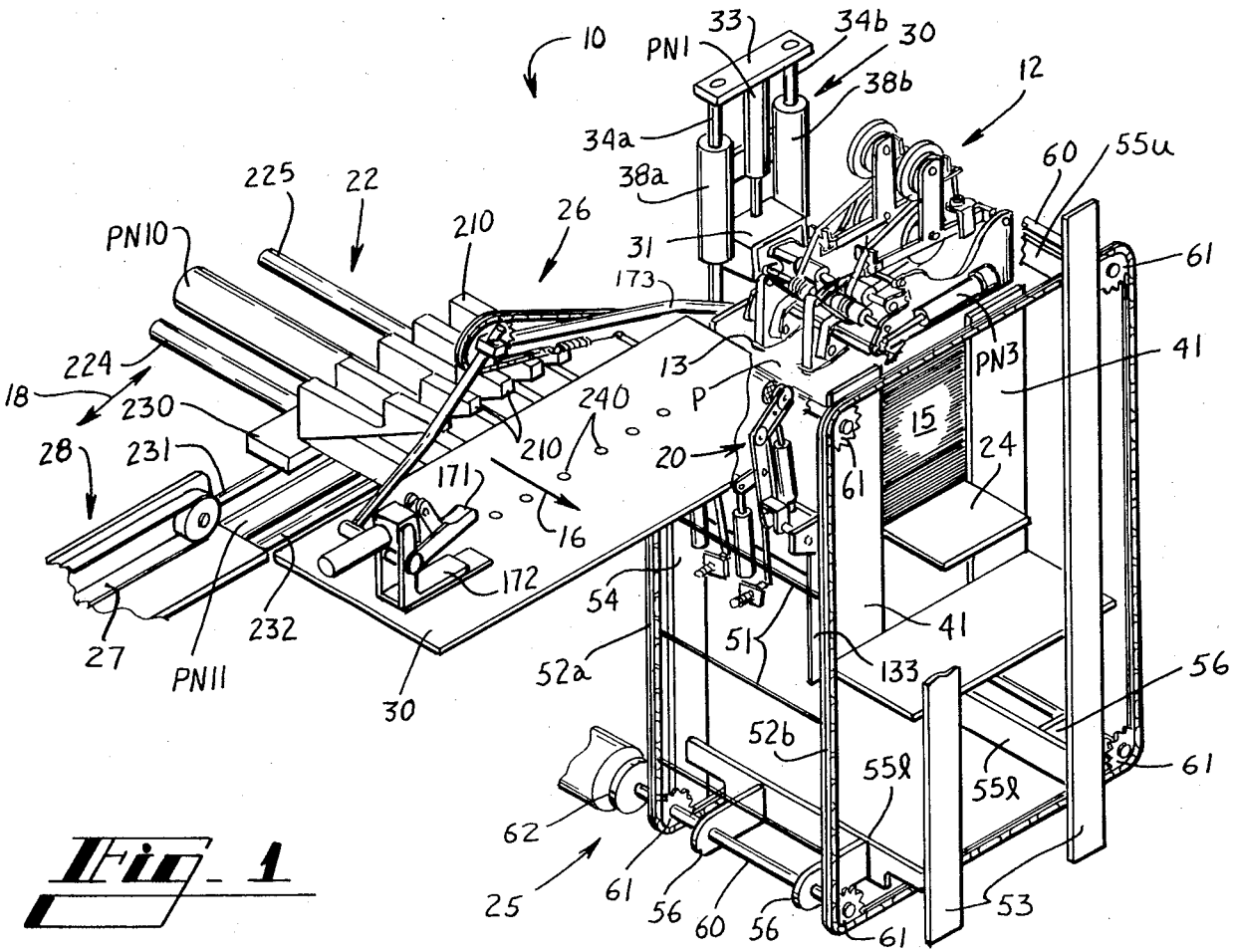
FIG. 1 is a pictorial view of the preferred embodiment of a single ply pickup apparatus constructed in accordance with the present invention.

Referring now to the drawings, in which like numerals indicate like elements throughout the several views, FIG. 1 shows a preferred embodiment of the single ply pickup and alignment apparatus 10 constructed in accordance with the present invention. The preferred embodiment employs several subsystems in order to effect isolation of a single ply, removal of the isolated single ply, and alignment of the ply prior to provision to a work station. A pickup carriage assembly 12 illustrated in detail in FIG. 4, lifts a peripheral edge of the topmost ply of a stack 15 of plies of cloth or other pliable material. A plurality of pick-up fingers 13 are employed to lift the peripheral edge of the topmost ply of the stack.

A peeler or spin off assembly 20 is provided for engaging with the lifted peripheral edge of the topmost ply and is operative to remove from the topmost ply any clinging peripheral edges of any plies which may adhere to the topmost ply because of static electricity, frictional bonding, or thread entanglement.

The pickup carriage assembly 12 is mounted to an carriage elevator assembly 21 which supports the carriage assembly above the top of the stack 15 and moves the carriage upwardly and downwardly. A stack elevator assembly 23 (FIG. 3) moves the stack 15 upwardly and downwardly by raising and lowering a stack platform 24. The combination of movements of the carriage elevator assembly 21 and the stack elevator assembly 23 causes the pickup fingers 13 to be engaged with the topmost member of the stack, and causes the stack to be lowered away from the carriage assembly as the pickup fingers 13 elevate the peripheral edge of the topmost ply, thereby creating a gap between the peripheral edge of the topmost ply and the remaining plies in the stack. It is into this gap that the peeler or spin off assembly 20 moves to peel off clinging plies.

A separator assembly 25 positively separates the topmost ply from the adjacent plies in the stack 15 by moving a separator rod or bar 51 into the gap between the lifted peripheral edge of the topmost ply and the remaining plies in the stack. A plurality of elongate wire-like separator rods 51 are supported at their ends between a pair of endless chains 52*a* and 52*b* which are mounted for parallel and simultaneous movement. After the peripheral edge is lifted to create a gap, the chains 52*a* and 52*b* are indexed to move one of the separator bars 51 across the top of the stack 15 to effect a positive separation.

After the ply has been isolated and separated, a pick off arm assembly 26 grasps the isolated edge with grasping fingers 171, 172, and pulls the ply from the stack across a work table 30.

After the ply is positioned on the work table 30, an alignment assembly 22 moves across the work table in the direction of arrow 16 to position a plurality of alignment fingers 210 over the work table 30. Air jets carried within the alignment fingers 210 force the ply inwardly toward the V of the alignment fingers and register the edge of the ply. The alignment assembly 22 then withdraws carrying the aligned ply and feeds it to a feeder belt 27 of a work station 28 such as a sewing machine or other processing equipment.

These assemblies perform the steps of engaging the topmost ply in the stack, lifting the peripheral edge of the topmost ply, removing any clinging plies from the topmost ply, grasping the uplifted peripheral edge of the topmost ply, positively separating the topmost ply from the remaining plies in the stack, and removing the topmost ply to the work table 30 where the alignment assembly 22 aligns the ply.

Figure 3:
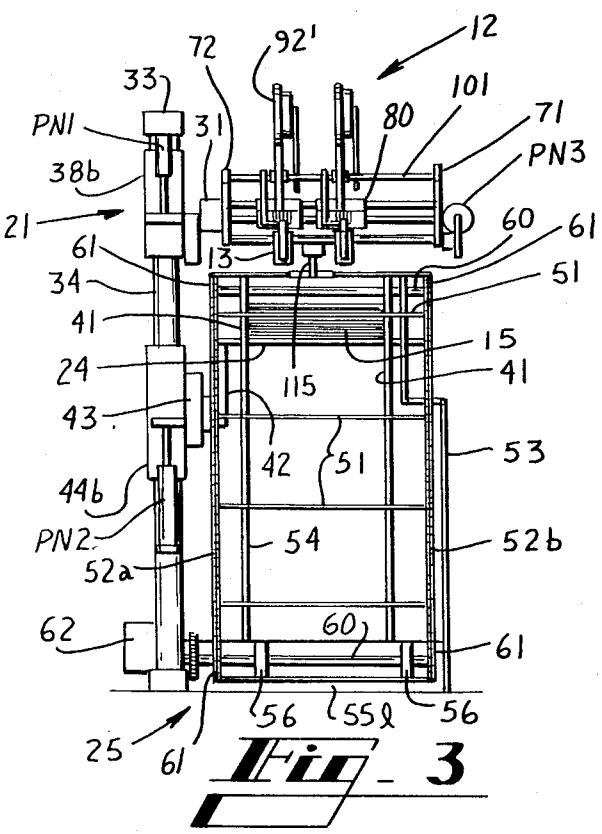
FIG. 3 is a front view of the single ply isolation apparatus taken along the line 3—3 of FIG. 2.
Figure 4:
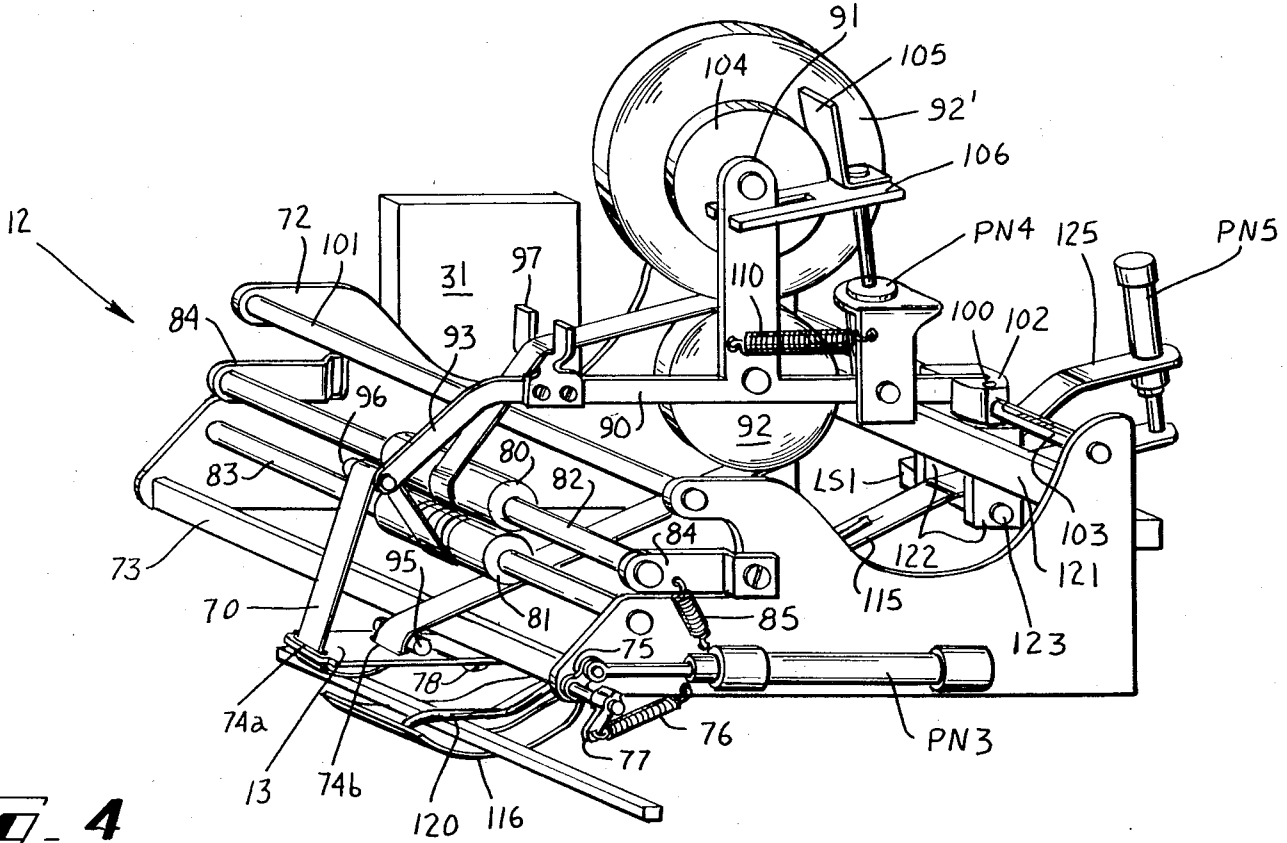
FIG. 4 is a pictorial view of the pickup carriage assembly.

As best seen in FIGS. 3 and 4, the pickup carriage assembly 12 is positioned directly above the stack 15 so that the pickup fingers 13 are supported directly above the topmost ply P of the stack.

The carriage assembly 12 is suspended over the stack 15 by an arm 31 which is connected to the actuator rod of a pneumatic cylinder PN1 which raises and lowers the carriage assembly. The base of pneumatic cylinder PN1 is attached to a mounting plate 33, which also supports a pair of vertically disposed parallel mounting bars 34*a* and 34*b*. The mounting bars 34 extend to the base of the device and also support the stack elevator assembly 23.

A pair of guide sleeves 38*a*, 38*b* are slidably fitted about the mounting bars 34*a*, 34*b* and are attached at the lower ends thereof to the arm 31 which supports the carriage assembly 12. The actuation of pneumatic cylinder PN1 raises and lowers the carriage elevator assembly 21 and the pickup carriage assembly 12 to bring the pickup fingers 13 into contact with the top of the stack. It will thus be appreciated that the carriage elevator assembly 21 comprises carriage elevator means for lowering the pickup fingers of the carriage assembly into proximity with the top of the stack and for raising the pickup fingers away from the stack.

As best seen in FIG. 3, the stack 15 of plies is placed atop of a flat stack platform 24 and confined at its outer edges by edge guides 41. The stack elevator assembly 23 then raises and lowers the stack within the confines of the edge guides. The stack platform 24 is attached to a mounting arm 42, which in turn is attached to a mounting plate 43. A second pair of guide sleeves 44 positioned below the carriage elevator guide sleeves 38 are slidably fitted about the mounting bars 34*a*, 34*b* and support the mounting arm 42 and mounting plate 43. The actuator rod of a pneumatic cylinder PN2 is attached to the mounting plate 43 between the mounting bars 34*a*, 34*b* and is operative to raise and lower the stack platform 24 so as to move the stack 15 upwardly and downwardly.

It will now be appreciated that the stack elevator assembly 23 comprises means for raising the stack of plies into proximity with the pickup carriage assembly 12 and pickup fingers 13, and for lowering the stack away to allow positive separation removal of a ply once the ply has been isolated.

Referring still to FIGS. 1 and 3, the separator assembly 25 may be seen to comprise a pair of endless chains 52*a*, 52*b* which are supported to index one of a plurality of elongate separator rods 51 across the top of the stack 15 to provide positive separation between plies. A frame comprising exterior upright frame members 53 and interior upright frame members 54 support the separator assembly 25 in the following manner. The interior upright frame members 54 are positioned adjacent the mounting bars 34*a*, 34*b*, while the exterior upright frame members 53 are disposed away from the mounting bars on the opposite side of the stack 15. Cross members 55 extend between the exterior frame members 53 and interior frame members 54 and support axle mounts 56.

Four axles 60 are supported by axle mounts 56 so as to suspend the endless chains 52*a*, 52*b* in a substantially square pattern extending beneath the lower most cross members 551 and above the uppermost cross members 55*u*. At the end of each of the axles 60 is a sprocket 61 which drives one of the endless chains. A driving motor 62 mounted to one of the axles drives both of the chains in tandem. Accordingly, it will be appreciated that movement of the motor 62 causes parallel movement of the chains 52*a*, 52*b* so that the separator rods 51 attached between the two chains travel a path which carries the separator rods across the top of the stack 15 and back around the loop of the endless chains. Since a plurality of separator rods 51 are provided, indexing one of the separator rods to travel across the width of the stack requires movement of the chains a predetermined amount which is basically the distance required for the indexed separator rod to travel across the entire length of the material in the stack. Signals for controlling the actuation of motor 62 in order to drive the motor this predetermined amount are provided after the peripheral edge of the topmost ply of the stack has been lifted and any excess or clinging plies have been removed by the spin-off assembly 20.

It will now be appreciated that the pickup carriage assembly 12 is suspended exteriorly of the path of the endless chains 52*a*, 52*b*, while the stack elevator assembly 23, and especially the stack platform 24 thereof, extends into the open area circumscribed by the endless chains, so that the separator bars 51 can enter into the gap created by the lifting of the peripheral edge of the topmost ply of the stack and any clinging plies which may still be on the stack.

It will be further appreciated that the separator assembly 25 including the separator rods 51 comprises separator means positioned adjacent to the peripheral edge of the topmost ply and movable laterally with respect to the stack into the gap, for providing positive separation of the topmost ply from the adjacent plies.

Turning to FIG. 4, the pickup carriage assembly 12 which lifts a peripheral edge of the topmost ply of the stack will now be described in more detail. The pickup carriage assembly comprises an outer support plate 71, and an inner support plate 72 attached to the arm 31 of the carriage elevator assembly 21. A pickup finger 13 is mounted to a pivoting lower support bar 73 which extends between the two support plates 71, 72. The pickup finger includes a pair of parallel slots 74*a*, 74*b* through which is threaded a strip of single-sided adhesive tape 70 which is used to engage and lift the peripheral edge of the topmost ply of the stack. The adhesive tape 70 is threaded through the slots 74*a*, 74*b* so that the adhesive surface of the tape is directly downwardly of the pickup finger 13.

A pneumatic cylinder PN3 is mounted to the outer support plate 71 and moves the pickup finger 13 from an essentially horizontal position for engaging the stack, to a tilted position 13' wherein the peripheral edge of the top ply in the stack is lifted. The actuator rod of cylinder PN3 is attached to a crank arm 75 which pivots the support bar 73 and raises the pickup finger when the cylinder is deactuated. A coil spring 76 attached at one end to the support plate 71 and at its other end to a second crank arm 77 on the support bar 73 assists in the return of the pickup finger to the horizontal position when air pressure in cylinder PN3 is released.

The pickup finger 13 is slidably received on the pivoting lower support bar 73 but held in place with a set screw 78 so that the position of the pickup finger can be laterally adjusted with respect to the top of the stack. Thereby, different widths of material can be accommodated. It will be understood that a plurality of pickup fingers 13 can be positioned on the support bar 73 to provide for different material widths, although only one is shown in FIG. 4.

A pair of tape feeder rollers 80, 81 are provided for each pickup finger and are supported between the support plates 71, 72 by a pair of parallel support bars 82, 83. The upper tape feeder roller 80 is positioned directly above the lower tape feeder roller 81 by a pivoting support bracket 84 which is biased downwardly by a coil spring 85 which has one end attached to the support plate 71 and the other end attached to the support bracket 84. Since the tape 70 passes between feeder rollers 80, 81, so that the adhesive surface contacts the lower roller 81, grooves are provided in this roller so that the adhesive of the tape does not adhere to the roller.

A generally horizontal tape support arm 90 including an upright portion 91 supports a fresh roll 92 of adhesive tape and a used roll 92'. The tape support arm 90 further includes a downwardly extending portion 93 which is disposed vertically over the pickup finger 13 and receives the used tape from the pickup finger after it exits the slot 74*a*. The fresh tape roll 92 is removably mounted on the tape support arm 90 for convenient replacement of the tape when the supply is exhausted.

The length of tape 70 from the fresh roll 92 is provided over a feed roller 95 mounted to the pivoting lower support bar 73, and threaded into the slot 74*b* in the pickup finger 13. Upon exiting the slot 74*a* of the pickup finger, the tape extends upwardly toward the downwardly extending portion 93 of the tape support arm 90 and over a roller 96 mounted at the end thereof. The tape passes over the roller 96 and beneath the grooved lower tape feeder roller 81. The tape then passes around the circumference of the lower tape feeder roller 81 and between the lower tape feeder roller 81 and the upper tape feeder roller 80. The tape then is received by a U-shaped tape guide 97 which is mounted to the tape support arm 90 near the downwardly extending portion 93. The tape then is provided to the take up or used adhesive tape roll 92' which is mounted in the upright portion 91 of the tape support arm 90.

The horizontal tape support arm 90 rests atop a front support bar 101 which extends between the support plates 71, 72, and is mounted to a mounting block 102 at the end of the carriage assembly 12 opposite the pickup fingers 13. The mounting block 102 is slidably mounted on a pivotable rear support bar 103 which also extends between the support plates 71, 72. A set screw 100 in the mounting block 102 allows adjustment of the tape support arm 90 along the length of the rear support bar 103 so that the roller 96 can be positioned above the pickup finger 13 during adjustment. It will thus be appreciated that the tape support arm 90 and the attached components pivot with the rear support bar 103 so as to facilitate removal and replacement of the adhesive tape rolls 92.

A fresh spot of tape for each ply is indexed into position on the pickup finger 13 by actuation of a pneumatic cylinder PN4 which is mounted to the horizontal tape support arm 90. The used tape roll 92' is received on a hub 104 having a textured outer surface and which is rotatably mounted to the upright portion 91 of the tape support arm. An indexing member 105 having a split guide member 106 is attached to the actuator rod of pneumatic cylinder PN4 and contacts with the textured surface of the hub 104. Upon acuation of the pneumatic cylinder PN4, the frictional contact between the indexing member 105 and the hub 104 causes rotation of the used tape roll 92'. The split guide member 106 is fitted about the upright portion 91 and maintains the indexing member 105 in alignment with the hub 104. A coil spring 110, attached at one end to the upright portion 91 and at the other end to the pneumatic cylinder PN4, biases the pneumatic cylinder PN4 and the indexing member 105 against the hub 104.

Still referring to FIG. 4, a stack sensing arm 115 is positioned beneath the pickup carriage assembly 12 so as to hold down the portion of the stack which are not lifted by the pickup fingers and to sense when the stack elevator assembly has raised the stack to within operable proximity of the pickup fingers. The stack sensing arm comprises a horizontal stack plate 116 attached to the sensing arm for contacting with the stack. An air jet 120 is provided in the stack plate 116 and directs a jet of air downwardly at the stack as the top most ply is removed to assist in removal of a single ply by blowing back any plies which might tend to cling to the removed ply.

The stack sensing arm 115 is pivotably supported by a horizontally extending cross bar 121 which is mounted between the support plates 71 and 72. A pair of support brackets 122 extend downwardly from the cross bar 121 and pivotably support a pivot pin 123 which is affixed to the stack sensing arm 115. The stack sensing arm 115 is raised to provide clearance for the passage of the separator rods by a pneumatic cylinder PN5. Cylinder PN5 is mounted to a support 125 which is attached to the cross bar 121 and extends rearwardly of the carriage assembly 12. A limit switch LS1 attached to the pivot pin 123 is actuated when the stack elevator is raised and brings the stack into contact with the stack plate 116. It will thus be appreciated that the top of the stack is sensed when the stack is elevated into the stack plate 116, actuating the limit switch LS1, thereby providing a signal to halt the stack elevator. When during the cycle the separator rods are to separate the topmost ply after the peripheral edge has been lifted, immediately prior to passage of the separator rod the pneumatic cylinder PN5 actuates and lifts the stack sensing arm 115 out of the path of the separator rod.

Figure 5:
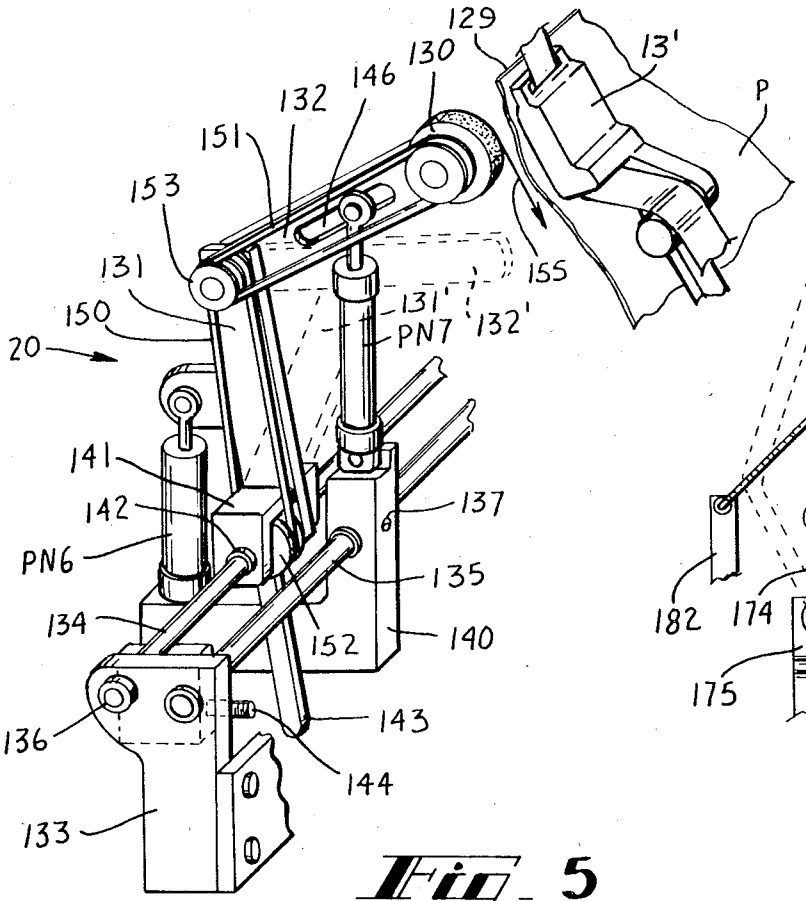
FIG. 5 is a pictorial view of the peeler or spin-off apparatus employed in the preferred embodiment.

The peeler or spin off assembly 20 is illustrated in more detail in FIG. 5. The spin off assembly comprises a wheel 130 mounted for rotation about an axis generally parallel to a portion of the peripheral edge 129 of the topmost ply P. The wheel reverse-spins to remove any plies which might cling to the topmost ply. The wheel is moved into proximity with the ply P after the peripheral edge has been lifted.

The assembly which supports the wheel is mounted to the end of a pair of articulated arms 131, 132 which are powered by pneumatic cylinders PN6 and PN7 to cause the wheel 130 to move inwardly and outwardly toward the uplifted edge and upwardly and downwardly against the stack. The articulated arms are adjustably mounted along the width of the stack so that the position of the wheel 130 can be adjusted with respect to the uplifted edge of the topmost ply of the stack.

Support brackets 133 mounted to the edge guides 41 in the front of the stack support a rotating drive rod 134 and a fixed support rod 135, both of which extend across the width of the stack. The rotating drive rod 134 is belt-driven by a motor (not shown) and supported by a bearing 136 for rotation.

An arm support block 140 is adjustably mounted on the fixed support rod 135 and is fastened thereto with a set screw 137. The arm support block 140 supports pneumatic cylinder PN6 which drives a first or lower arm 131 toward and away from the front of the stack, and pneumatic cylinder PN7 which drives a second or upper arm 132 upwardly and downwardly of the top of the stack.

The first or lower arm 131 pivots about the axis of the rotating drive rod 134, and includes a bearing extension 141 which supports a bearing 142 for the rotating drive rod 134. The lower arm 131 further includes a stop extension 143 which extends downwardly and rests against a screw stop 144 in the arm support block 140.

By adjusting screw stop 144, the inward movement of the lower arm 131 toward the stack can be limited.

The second or upper arm 132 is pivotally attached at one end to the upper end of the lower arm 131, and supports the wheel 130 at the other end. A pneumatic cylinder PN7 whose base is mounted to the arm support block 140 raises and lowers the upper arm 132. An elongate slot 146 in the upper arm 132 receives the actuator rod of the pneumatic cylinder PN7. Deactuation of the pneumatic cylinder PN7 causes the upper arm 132 to assume the downward position 132'.

Actuation of the pneumatic cylinder PN6 causes the first or lower arm 131 to assume the position 131', moving the wheel 130 into proximity with the uplifted edge of the ply P.

A pair of belts 150, 151 drive the wheel 130. The belts are driven by the rotation of the rotating drive rod 134, which rotates a drive wheel 152 which is supported within the bearing extension 141 of the lower arm 131. A lower belt 150 is driven by the drive wheel 152 and drives an idler wheel 153 which is mounted at the upper end of the lower arm 131. An upper belt 151 driven by the movement of the idler wheel 153 drives the spin off wheel 130, which is carried at the extreme end of the second or upper arm 132.

The spin off wheel 130 has a textured or roughened surface so that it will catch and spin off any plies which may cling to the top most ply. In the preferred embodiment, the wheel spins in a direction so as to remove clinging plies from the ply P and to replace them on the top of the stack. This direction may be described as "reverse spinning," which means that the wheel spins in a direction such that the instantaneous velocity vector 155 tangent to the wheel 130, where the wheel contacts any clinging plies, is directed inwardly of the ply P from the peripheral edge 129 of the ply P. It will thus be appreciated that any clinging plies have a tendency to be removed from the topmost ply P and to be spun back onto the stack. After spinning off these unwanted plies, the upper arm 132 is lowered to 132', and the wheel 130 stops spinning, clamping the plies to the top of the stack and allowing the separator rod to pass over the top of the wheel.

It will now be appreciated that the peeler or spin off assembly 20, as above described, comprises means for engaging with the lifted peripheral edge of the topmost ply and for removing any clinging plies which may adhere to the topmost ply because of static electricity, thread entanglement, or the like. It will further be appreciated that the pneumatic cylinders PN6, PN7 comprise means for moving the peeler into and out of engagement with the ply.

Figure 6:
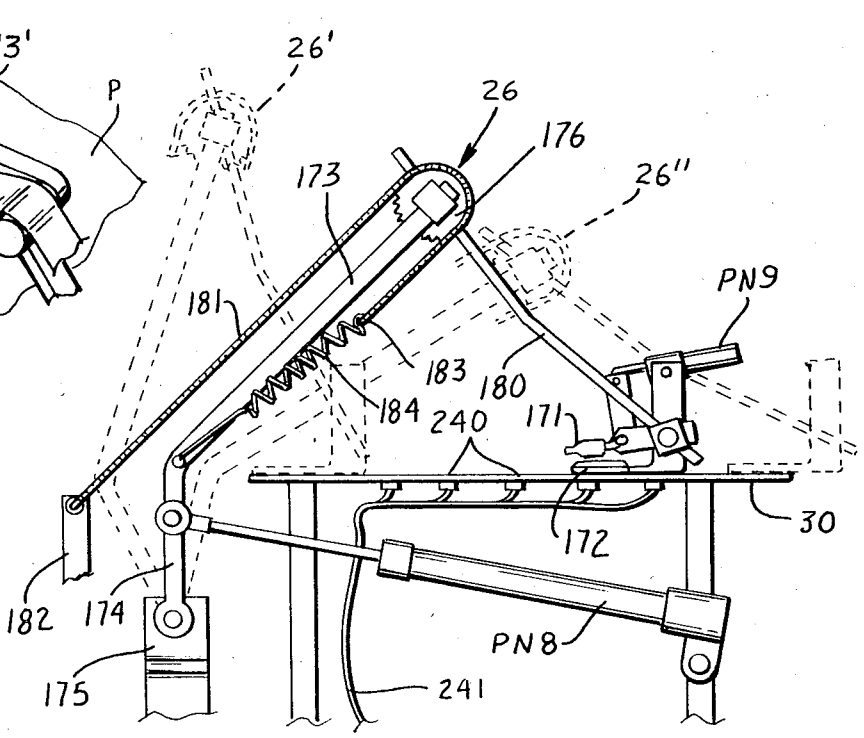
FIG. 6 is a rear view of the grasping arm used to move a single ply from the ply isolator to the work table.

FIG. 6 illustrates from the rear the pick off arm assembly 26 shown generally in FIG. 1. The pick off arm assembly grasps the isolated topmost ply with grasping fingers 171, 172 and removes the ply across the work table 30. The pick off arm assembly 26 includes a first arm bar 173 having a bent lower portion 174 which is pivotally mounted to a mounting block 175. At the upper end of the first arm bar 173 there is pivotably attached a sprocket 176. A second arm bar 180 extends downwardly from the upper end of the first arm bar 173 toward the work table 30 and supports the grasping fingers 171, 172.

A pneumatic cylinder PN8 moves the pick off arm assembly 26 between the position shown at 26' wherein the topmost ply of the stack is picked off, and the position at 26'' wherein the ply is pulled across the work table 30 and deposited thereon for alignment. The actuator rod of the pneumatic PN8 is attached to the bent lower portion 174 of the first arm bar 173.

The first arm bar 173 and the second arm bar 180 are articulated to maintain the grasping fingers 171, 172 in contact with the work table 30. A chain 181 attached at one end to a support 182 mounted to the frame is provided along the length of the first arm bar 173 and around the sprocket 176. A free end 183 of the chain 181 is attached to a coil spring 184 whose other end is attached to the first arm bar 173. Since the second arm bar 180 pivots with respect to the first arm bar 173 at the sprocket 176, movement of the pick off arm assembly from the position shown at 26' to that shown at 26'' causes the chain 181 to exert rotational force against the sprocket 176, thereby causing the second arm bar 180 to extend outwardly, thereby maintaining the grasping fingers 171, 172 in close proximity to the top of the work table 30.

A pneumatic cylinder PN9 mounted to the lower end of the second arm bar 180 opens and closes the grasping fingers 171, 172 so as to grasp the top ply when the pick off arm assembly is at the position 26', and to release the ply when the assembly has reached the position 26''.

Figure 7:
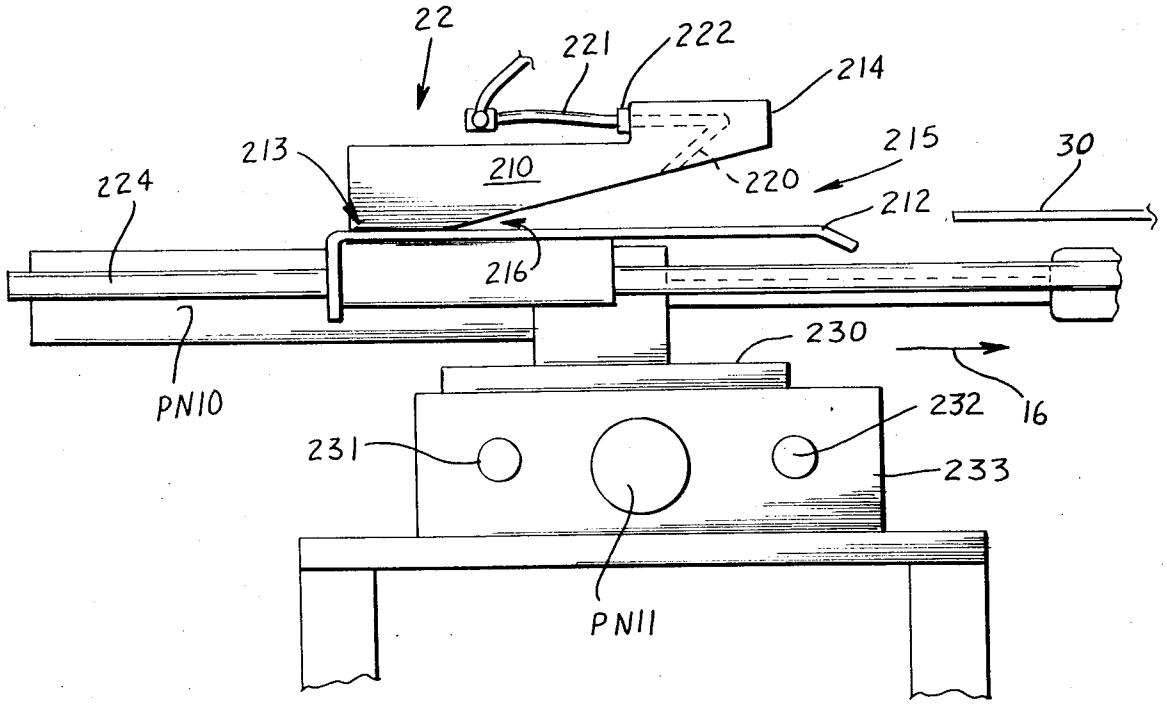
FIG. 7 is a side view taken along the line 7—7 of FIG. 2 of the alignment assembly.

FIG. 7 illustrates in greater detail the alignment assembly 22 which is employed in the preferred embodiment for aligning a particular edge of the ply of material in preparation for feeding the aligned ply to work station 28 (FIG. 1). The alignment assembly 22 includes the work table 30 which receives an unaligned ply after the pick off arm assembly 26 has removed a single ply from the stack and pulled the ply across the work table.

The alignment assembly 22 further comprises, as best seen in FIGS. 1 and 7, a plurality of alignment fingers 210 which are mounted to a horizontal mounting plate 212. Each alignment finger 210 is preferably constructed of a block of aluminum or the like which has been shaped so that one end 213 of the finger 210 may be attached to the mounting plate 212, while the other end 214 is supported above the mounting plate 212 disposed toward the work table 30. The lower surface of the alignment finger 210 together with the mounting plate 212 define a relatively wide ply-receiving area 215 disposed toward the work table, and an a V-shaped edge stop 216 defined at the juncture of of the alignment finger 210 and the mounting plate 212.

An air passage 220 is drilled into the alignment finger 210 at an angle which directs a jet of air downwardly toward the mounting plate 212 and inwardly toward the edge stop 216. An air hose 221 provides a supply of air through a fitting 222 to the air passage 220 so that a burst of air may be directed from the alignment finger 210 toward the mounting plate 212.

A pneumatic cylinder PN10 moves the alignment fingers 210 toward and away from the work table 30. As the alignment fingers approach the work table, the mounting plate 212 passes beneath the work table 30 so that the outlet of the air passage 220 is positioned over the work table 30. A pair of guide rods 224, 225 guide the alignment fingers over the work table in the direction of arrow 16.

The entire assembly including pneumatic cylinder PN10, guide rods 224, 225, alignment fingers 210, and mounting plate 212 is mounted to a mounting plate 230 which is movable toward and away from the work station 28 (FIG. 1) in the direction of arrow 18. A pneumatic cylinder PN11 moves the assembly mounted to the mounting plate 230 toward and away from the work station 28, parallel to the work table 30, so as to feed the aligned ply into the work station. Guide rods 231, 232 received within a guide plate 233 guide the movement of the mounting plate 230 and attached components toward and away from the work station.

It will now be appreciated that the stream of air from the air passage 220 moves a ply on the work table 30 inwardly of the alignment fingers 210 until the edge of the ply registers with the edge stops 216, and maintains the edge registered against the stops as the alignment assembly 22 retracts away from the work table carrying the ply and toward the work station 28 for discharge of the ply. Advantageously, and because of the V-shaped ply-receiving feature of the alignment fingers, buckling and warping of the aligned ply is minimized since the edge of the ply does not encounter a vertical surface against which the edge might climb if sufficient force were directed against the ply.

It will also be appreciated that the combination of pneumatic cylinders PN10 and PN11, together with their respective guide rods, comprise alignment assembly moving means for moving the alignment assembly 22 toward the work table 30 to receive an unaligned ply on the work table, and for moving the alignment assembly away from the work table carrying an aligned ply toward the work station. It will be further appreciated that the alignment assembly moves laterally in two directions, laterally between a first position for receiving an unaligned ply and a second position away from the work table for discharging the aligned ply, and laterally away from the second position to a third position toward the work station 28 to discharge the aligned ply into the work station.

Figure 2:
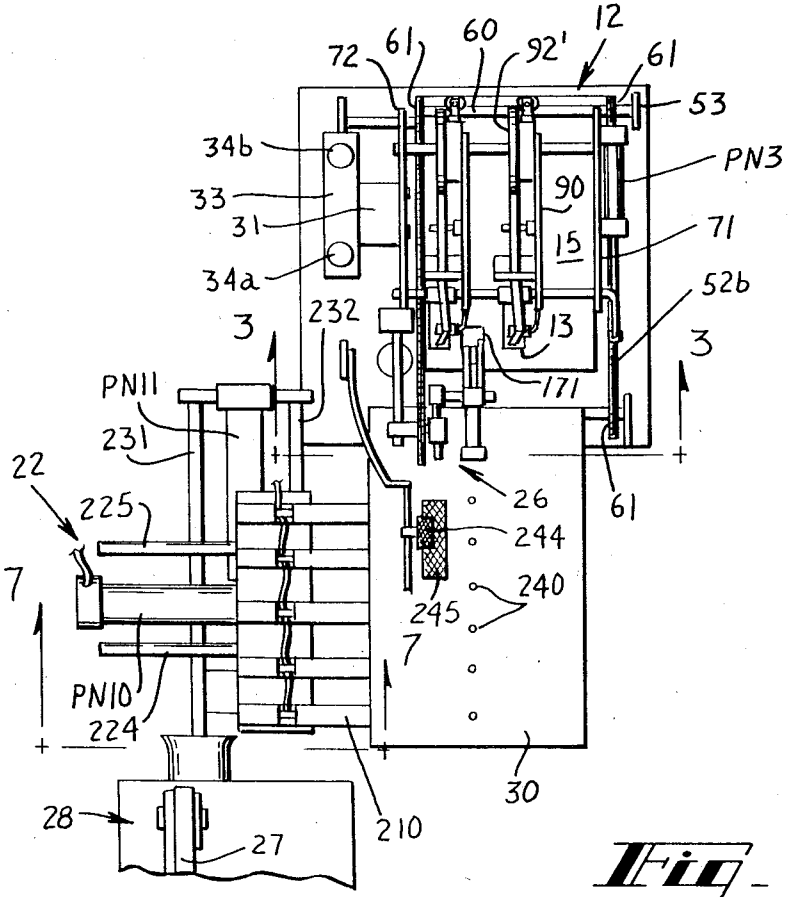
FIG. 2 is a top plan view of the apparatus shown in FIG. 1.

As best seen in FIGS. 2 and 6, the work table 30 is provided with a plurality of openings 240 connected to a vacuum line 241. These openings hold the ply against the work table as the ply is drawn across the work table, and further serve to hold the ply in position while the alignment assembly 22 is positioning the alignment fingers over the work table so as to align and remove the ply. Also shown in FIG. 2 is an optical sensor 244 suspended over a strip of reflective tape 245, which senses whether a ply has been successfully grasped by the grasping fingers 171, 172 and is in place on the work table. It will of course be understood that the similar sensors may be positioned at various locations to sense proper operation or signal a malfunction.

OPERATION

The preferred embodiment employs a programmable sequence controller to control the sequence of actuation and deactuation of the pneumatic cylinders PN1–PN11, the indexing of the separator bar, and other movements. The sequence controller (not illustrated) receives electrical input signals from limit switch LS1, optical sensor 244, and other limit switches not illustrated, and provides signal outputs to actuate solenoid valves and relays to control the pneumatic cylinders and motors. The preferred embodiment employs a model SYSMAC-PO pneumatic sequence controller manufactured by Omron Electronics Inc., of Schaumburg, Ill. Those skilled in the art will understand how to program such a programmable controller to perform the steps taken in the disclosed embodiment to effectuate single ply isolation and removal, after the discussion which follows.

Figure 8:
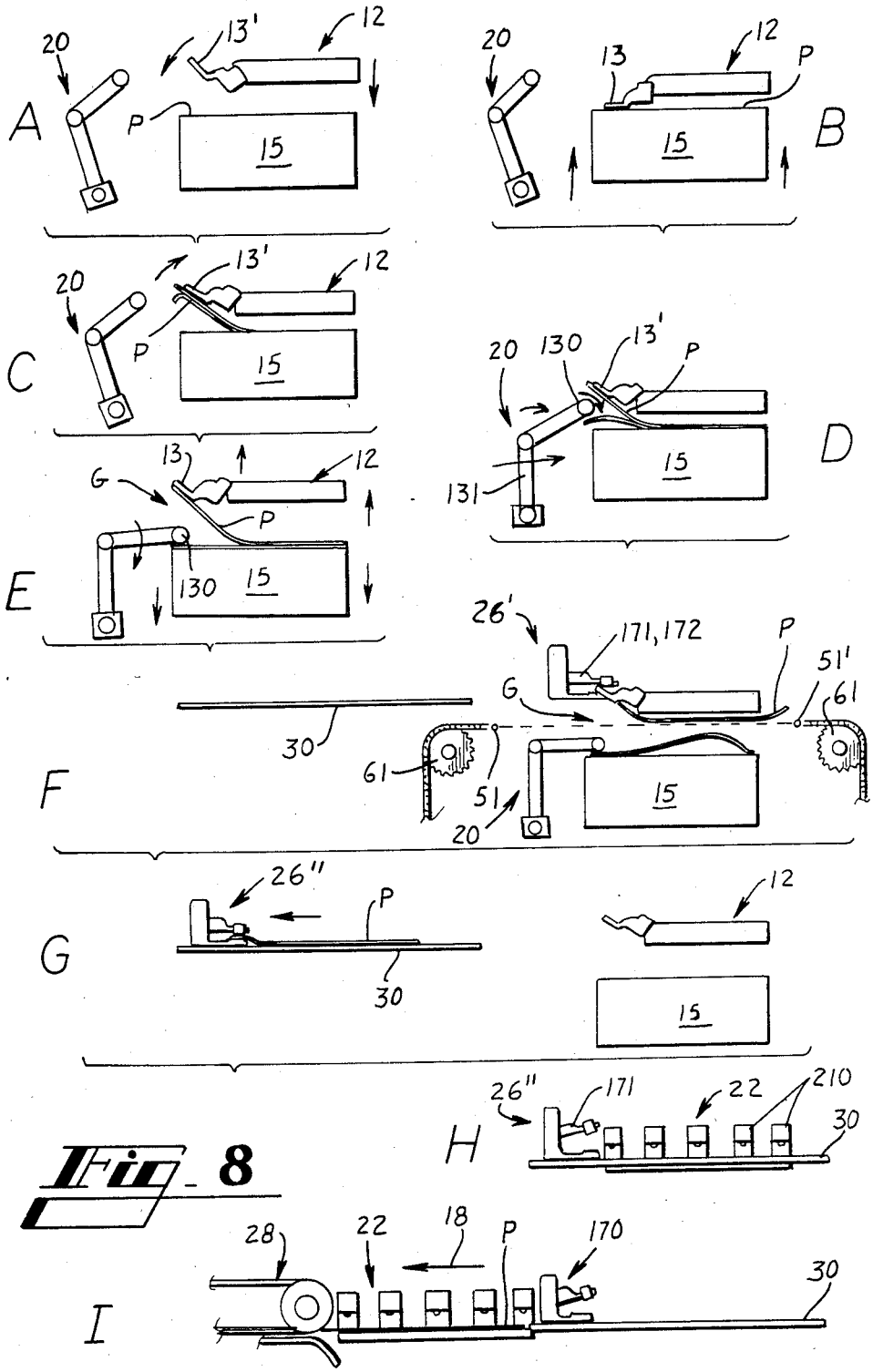
FIGS. 8A–8I illustrate the steps taken in the preferred embodiment to isolate a single ply, to remove the single ply to the work table, to align the single ply, and to feed the aligned ply to a sewing machine.

FIG. 8 illustrates the steps taken in the disclosed embodiment in isolating and removing a single ply from the stack, and for aligning the ply and feeding it into the work station. In FIG. 8A, the first step taken is to lower the pickup carriage assembly 12 toward the stack 15 by the actuation of pneumatic cylinder PN1. The pickup fingers 13 are lowered by pneumatic cylinder PN3 so that the fingers are horizontal and parallel with the stack. The apparatus is now ready to raise the stack 15, bringing the top ply P into contact with the adhesive tape carried by the pickup fingers 13.

In FIG. 8B, pneumatic cylinder PN2 is actuated, thereby raising the stack 15 and bringing the topmost ply P into contact with the pickup finger 13. The actuation of limit switch LS1 provides a signal to the controller that the stack has been raised to within operable proximity of the pickup carriage assembly 12.

In FIG. 8C, pneumatic cylinder PN3 retracts, and the pickup finger 13 elevates to position 13', thereby lifting the peripheral edge of the topmost ply P of the stack 15, and possibly lifting the peripheral edges of plies which might cling to the topmost ply.

The next step taken is to insure that any plies which might cling to the topmost ply P are spun off the topmost ply and replaced unto the stack. This step is illustrated in FIG. 8D. The rotation of the spin off wheel 130 is begun, and the first or lower arm 131 of the peeler or spin off assembly 20 is brought toward the stack 15 by actuation of cylinder PN6. As the wheel 130 approaches the peripheral edge of the plies lifted by the pickup fingers, any clinging plies will be removed from the top most ply. The clearance between the wheel 130 and the pickup finger 13 is preferably adjusted so that the spin off wheel approaches very close to but does not physically touch the topmost ply carried by the pickup fingers or the pickup finger itself. Those skilled in the art will appreciate that by adjusting the screw stop 144 (FIG. 5), the spin off wheel 130 can be brought as close to the pickup finger 13 as required to spin off any excess plies without approaching so closely as to contact with the topmost ply which should remain adhered to the pickup finger by virtue of the adhesive tape.

In FIG. 8E, the spin off wheel 130 clamps the spun-off plies against the top of the stack 15, as the second or upper arm 132 of the spin off assembly 20 moves downwardly by the reverse actuation of pneumatic cylinder PN7. The spinning motion of the spin off wheel is halted as the wheel approaches the top of the stack. The carriage assembly 12 then elevates by actuation of cylinder PN1, further raising the peripheral edge of the now-isolated topmost ply P; the stack 15 in the preferred embodiment is also lowered by the actuation of cylinder PN2. It will now be appreciated that there has been created a gap G between the lifted peripheral edge of the topmost ply and the remaining plies in the stack.

In FIG. 8F, the next step taken is to move one of the separator rods 51 into the gap G so as to provide positive separation of the top most ply from the remaining plies in the stack. Immediately prior to this positive separation, however, it is preferable to grasp the now isolated topmost ply P with the grasping fingers 171, 172, in preparation for removal of the ply and to insure that as the topmost ply is positively separated from the remaining plies, the separator rod does not pull the topmost ply off the adhesive tape.

The positive separation is effected by indexing the endless chains 52*a*, 52*b* by actuating motor M1 for a time sufficient to move the separator rod 62 closest to gap G into the gap and across the top of the stack 15, until it reaches the position 51' wherein it has completely traversed the top of the stack. It will thus be appreciated that there has been provided positive separation of the topmost ply from the remaining plies. It will be further appreciated that the effects of any frictional or static electrical bonds or thread entanglement between the topmost and remaining plies will be minimized due to this positive separation action.

In FIG. 8G, the pick off arm assembly 26 pulls the single ply across the work table 30 as the pneumatic cylinder PN8 reverse actuates bringing the grasping fingers and the ply across the work table 30. At this point, the single ply separation process has been completed. and the steps shown beginning in FIG. 8A may be begun again in preparation for the isolation and separation of the next ply in the stack.

As respects the ply just removed, which has been drawn across the work table 30, in FIG. 8H, the next step taken is to position the alignment assembly 22 over the work table so that the single ply may be aligned in preparation for feeding to the work station. Pneumatic cylinder PN10 actuates, bringing the alignment fingers 210 into the first position over the work table 30, thereby positioning the air passages 220 over the ply so that a blast of air can force the edge of the ply against the edge stops.

After the ply has been aligned, the alignment assembly 22 retracts to a second position by reverse actuation of pneumatic cylinder PN10, in preparation for feeding the now-aligned ply to the work station 28. In FIG. 8I, this step is illustrated as the alignment assembly 22 moves from its second position to its third position for feeding the ply P into the work station 28 such as the feed belt 27 of a sewing machine or the like. After the ply has been effectively engaged at the work station, the alignment assembly 22 can return to the second position wherein the assembly is adjacent the work table 30, awaiting the next single ply drawn across the work table by the pick off arm assembly 26.

It will be understood by those skilled in the art that the steps illustrated in FIGS. 8A–8I represent a possible series and sequence of steps which may be taken to accomplish the objectives of the present invention, but that other sequences of steps may be employed with success in accomplishing the isolation, separation, and removal of a single ply and the alignment thereof in preparation for providing the ply to a work station. In particular, it will be understood that certain sequences may be slightly modified so as to enhance simultaneity or economy of motion; for example, it is within the contemplation of the present invention that the topmost ply may be engaged by lowering the pickup carriage assembly 22 and pickup fingers onto the stack 15 after the stack has been raised, as opposed to raising the stack into contact with the pickup fingers. As another example, it is also contemplated that the alignment asembly 22 after it engages and removes the ply from the work table 30 can move with a degree of simultaneous motion of both of cylinders PN10 and PN11, instead of the illustrated sequence wherein cylinder PN10 is actuated prior to PN11. It is further contemplated that various optical sensors, limit switches and the like in addition to those described may be provided at various locations in the apparatus for sensing proper operation and for triggering certain sequences and operations possible in the disclosed embodiment while still remaining within the principal objective of the present invention, that of isolation, separation, and removal of a single ply from a stack of plies.

Accordingly, it will be understood that the preferred embodiment of the present invention has been disclosed by way of example and that other modifications and alterations may occur to those skilled in the art without departing from the scope and spirit of the appended claims.

We claim:

1. Apparatus for providing positive separation of adjacent plies of material in a stack of plies, comprising:

means for lifting a peripheral edge of the topmost ply of the stack of plies in order to create a gap between the topmost ply and the adjacent ply;

rotating peeler means for engaging any plies clinging to the topmost ply lifted by said lifting means from the underside of the topmost ply and operative to remove from the topmost ply any clinging plies by moving along a path beneath the lifted topmost ply to frictionally engage and spin off any such clinging plies;

peeler moving means for moving said peeler means into engagement with any clinging plies and to firmly hold any removed clinging plies to the top of the stack;

separator means positioned adjacent to the peripheral edge of the topmost ply and movable laterally with respect to the stack into said gap; and separator moving means for moving said separator means laterally into said gap and across the stack in order to positively separate the topmost ply from the remaining plies in the stack.

2. Apparatus according to claim 1, further comprising stack elevator means for raising the stack of plies into proximity with said edge lifting means and for lowering the stack of plies away from said edge lifting means to allow said separator means to move across the stack.

3. Apparatus according to claim 1, wherein said edge lifting means is mounted to a movable carriage, and further comprising carriage moving means for moving said edge lifting means into proximity with the stack of plies and for moving said edge lifting means away from the stack to allow said separator means to move across the stack.

4. Apparatus according to claim 1, wherein said edge lifting means comprises:

a ply-engaging finger movable between a first ply-engaging position and a second raised position, and ply holding means affixed to said ply-engaging finger for retaining and lifting the peripheral edge of the topmost ply as said ply-engaging finger moves from said ply-engaging position to said raised position.

5. Apparatus according to claim 4, wherein said ply holding means comprises an elongate strip of adhesive tape, and further comprising means for indexing a fresh spot of adhesive into position on said ply-engaging finger in preparation for lifting the edge of a ply.

6. Apparatus according to claim 1, wherein said separator means comprises an elongate wire rod mounted at each end to one of a pair of endless chain loops, and wherein said separator moving means is operative to move said chain loops an amount sufficient to cause said rod to move along and across the stack to positively separate the topmost ply from the remaining plies.

7. Apparatus for isolating a peripheral edge of the topmost ply of a stack of plies so that the topmost ply can be removed for subsequent processing, comprising:

means for vertically lifting a peripheral edge of the topmost ply of the stack of plies;

selectively actuatable rotating peeler means for frictionally engaging regions proximate to the lifted peripheral edge of the topmost ply lifted by said lifting means, and operative to remove from the topmost ply any clinging plies by urging said clinging plies downwardly away from the topmost ply;

peeler moving means for moving said peeler means toward the lifted peripheral edge of the topmost ply and into engagement with said clinging plies; and control means operative to actuate said peeler means to rotate, to cause said peeler moving means to move said peeler means into engagement with said clinging plies to spin said clinging plies away from said topmost ply, to cause said peeler moving means to move said peeler means downwardly away from said topmost ply and onto the stack, and to deactuate said peeler means to clamp the remaining plies onto the stack.

8. Apparatus according to claim 7, further comprising means for grasping the peripheral edge of the topmost ply, and grasper moving means operative to move said grasping means and the topmost ply away from the stack and toward a work station.

9. Apparatus according to claim 7, wherein said peeler means comprises a wheel mounted for rotation about an axis generally parallel to a portion of the peripheral edge of the topmost ply lifted by said lifting means, and further comprising wheel moving means operative to spin said wheel to remove any clinging plies from the topmost ply.

10. Apparatus according to claim 9, wherein said wheel is operative to spin in a direction such that the instantaneous velocity vector tangent to said wheel where said wheel contacts any clinging plies is directed inwardly of the ply with respect to the peripheral edge of the topmost ply lifted by said lifting means.

11. Apparatus according to claim 7, wherein said peeler moving means comprises:

a first arm mounted for movement toward and away from the stack, a second arm pivotally mounted to said first arm at one end and movably supporting said peeler means at the other end, first arm moving means for moving said first arm toward the stack to engage said peeler means with any clinging plies to remove any such clinging plies from the topmost ply, and for retracting said first arm away from the stack, and second arm moving means for moving said second arm and said peeler means downwardly toward the top of the stack to clamp any removed plies to the top of the stack.

12. Apparatus according to claim 11, further comprising stack elevator means for raising the stack of plies into proximity with said edge lifting means and for lowering the stack away from said edge lifting means to allow removal of the isolated topmost ply, and wherein said second arm moving means is operative to hold said peeler means against the top of the stack after any clinging plies have been removed from the topmost ply to clamp such removed plies against the stack as said stack elevator means lowers the stack.

13. In an apparatus for separating and removing a single ply of material from a stack of plies, said apparatus comprising ply isolation means for isolating the topmost single ply from the stack and ply removing means for removing the isolated single ply, an improved ply isolator for removing any clinging plies from the topmost ply, comprising:

peeler means for frictionally engaging with any clinging plies which may adhere to the topmost ply and operative to remove such clinging plies from the topmost ply, a first arm mounted for movement toward and away from the stack, a second arm pivotably mounted to said first arm at one end and movably supporting said peeler means at the other end, first arm moving means for moving said first arm toward the stack to engage said peeler means with any clinging plies to remove any such clinging plies from the topmost ply, and for retracting said first arm away from the stack; and second arm moving means for moving said second arm and said peeler means downwardly toward the top of the stack to clamp any removed clinging plies to the top of the stack.

14. The improvement of claim 13, wherein said peeler means comprises a wheel mounted for rotation about an axis generally parallel to a portion of a peripheral edge of the topmost ply, and further comprising wheel motor means operative to spin said wheel to remove any clinging plies from the topmost ply.

15. The improvement of claim 14, wherein said wheel is operative to spin in a direction such that the instantaneous velocity vector tangent to said wheel where said wheel contacts any clinging plies is directed away from the peripheral edge of the topmost ply and inwardly of the topmost ply.

16. A method for isolating and removing a single ply of material from a stack of plies, comprising the steps of:

engaging the topmost ply in the stack with an adhesive lifting member;

lifting a peripheral edge of the topmost ply by raising the adhesive lifting member;

removing any clinging plies from the topmost ply by moving a spinning wheel toward the underside of the uplifted peripheral edge of the topmost ply to engage any clinging plies;

clamping any plies removed from the topmost ply against the top of the stack with clamping means;

grasping the uplifted peripheral edge of the topmost ply with grasping means;

positively separating the topmost ply from the remaining plies in the stack by moving a separator into the gap between the uplifted peripheral edge of the topmost ply and the remaining plies in the stack, and along the width of the stack while the clamping means clamps the remaining plies in the stack; and removing the topmost ply by withdrawing the grasping means away from the stack.

17. Apparatus for isolating a peripheral edge of the topmost ply of a stack of plies so that the topmost ply can be removed for subsequent processing, comprising:

means for vertically lifting a peripheral edge of the topmost ply of the stack of plies;

peeler means for engaging the lifted peripheral edge of the topmost ply lifted by said lifting means and operative to remove from the topmost ply any clinging plies; and peeler moving means for moving said peeler means into engagement with the lifted peripheral edge of the topmost ply, said peeler moving means comprising:

a first arm mounted for movement toward and away from the stack, a second arm pivotally mounted to said first arm at one end and movably supporting said peeler means at the other end, first arm moving means for moving said first arm toward the stack to engage said peeler means with any clinging plies to remove any such clinging plies from the topmost ply, and for retracting said first arm away from the stack, and second arm moving means for moving said second arm and said peeler means downwardly toward the top of the stack to clamp any removed plies to the top of the stack.

18. Apparatus according to claim 17, further comprising stack elevator means for raising the stack of plies into proximity with said edge lifting means and for lowering the stack away from said edge lifting means to allow removal of the isolated topmost ply, and wherein said second arm moving means is operative to hold said peeler means against the top of the stack after any clinging plies have been removed from the topmost ply to clamp such removed plies against the stack as said stack elevator means lowers the stack.

* * * * *